US006640893B1

(12) United States Patent
Rummel et al.

(10) Patent No.: US 6,640,893 B1
(45) Date of Patent: Nov. 4, 2003

(54) WELLBORE PACKER

(75) Inventors: Fritz Rummel, Bochum (DE); Paul Hegemann, Haltern (DE); Jörg Baumgärtner, Kapsweyer (DE)

(73) Assignees: Groupement Europeen d'Interet Economique "Exploitation" Miniere de la Chaleur (G.E.I.E. EMC), Kutzenhausen (FR); MeSy Geo Messsysteme GmbH "MeSy", Bochum (DE)

( * ) Notice: Subject to any disclaimer, the term of this patent is extended or adjusted under 35 U.S.C. 154(b) by 0 days.

(21) Appl. No.: 09/937,822

(22) PCT Filed: Mar. 29, 2000

(86) PCT No.: PCT/FR00/00784

§ 371 (c)(1),
(2), (4) Date: Sep. 28, 2001

(87) PCT Pub. No.: WO00/58601

PCT Pub. Date: Oct. 5, 2000

(30) Foreign Application Priority Data

Mar. 29, 1999 (FR) ..... 99 03871

(51) Int. Cl.[7] ..... E21B 33/127
(52) U.S. Cl. ..... 166/187; 166/203
(58) Field of Search ..... 14/179, 187, 203, 14/387

(56) References Cited

U.S. PATENT DOCUMENTS

| | | | | |
|---|---|---|---|---|
| 2,701,615 A | | 2/1955 | Riordan, Jr. et al. | |
| 4,421,165 A | | 12/1983 | Szarka | |
| 4,515,213 A | | 5/1985 | Rogen et al. | |
| 5,143,154 A | | 9/1992 | Mody et al. | |
| 5,327,962 A | | 7/1994 | Head | |
| 5,941,313 A | * | 8/1999 | Arizmendi | 166/387 |
| 6,009,951 A | * | 1/2000 | Coronado et al. | 166/387 |
| 6,301,959 B1 | * | 10/2001 | Hrametz et al. | 73/152.23 |

* cited by examiner

*Primary Examiner*—William Neuder
(74) *Attorney, Agent, or Firm*—Young & Thompson

(57) ABSTRACT

The invention relates to a packer for a wellbore, comprising a central tubular element (7) covered by a deformable peripheral sleeve (5). Fluid is injected inside the tubular element under pressure in order to form said sleeve (5) and to apply it to the walls of the wellbore (3). The inventive device is characterized in that the deformable sleeve (5) is made out of metal and the inner wall of the sleeve (5) comprises at least one annular chamber (17) that extends over at least one part of the surface of the sleeve (5) and communicates with the inside of the packer via an orifice (19), whereby said chamber (17) is filled with a material that is non-miscible with respect to the wellbore fluid prior to the injection of said fluid under pressure.

20 Claims, 2 Drawing Sheets

WELLBORE PACKER

BACKGROUND OF THE INVENTION

The present invention relates to packing devices of inflatable type used in boring techniques.

DESCRIPTION OF THE RELATED ART

In effect, it is known that, in these techniques, obturating devices are called upon, within the framework of diverse applications, which are placed in position in the wellbores and which, at the required depth, are activated by employing inflation means.

Such obturating devices, usually called "packers", are constituted by cylindrical tubular elements whose outer wall is constituted by a sleeve made of elastomer which is maintained between two metallic rings allowing it to be connected to an upstream and possibly downstream bore pipe.

It is known that packers are intended essentially to perform two functions, namely a function of anchoring and a function of seal with the rocks adjacent the wellbore. To that end, after introduction of the packer in the wellbore to the desired level, the elastomer sleeve is inflated by an injection under pressure of a fluid such as, preferably, cement, or by mechanical compression.

One difficulty arises from the fact that a packer must withstand considerable loads, sometimes exceeding one hundred tons, so that the stresses, particualrly the shear stresses, which are exerted on the elastomer sleeve cause a deformation thereof which is detrimental, on the one hand, to the quality of its anchoring and, on the other hand, to its qualities of seal.

This difficulty is increased due to the fact that the packer must perform the afore-mentioned functions while it is located in a particularly hostile environment, in particular by reason of the aggressive nature of the fluids encountered and the high temperatures. The effects of the latter are felt all the more so as the packer is at a considerable depth, in zones where the temperatures may sometimes exceed values of the order of 150° C. It will be understood that, under such conditions, the mechanical qualities of the elastomer constituting the inflatable sleeve of the packers are much lessened.

In order to reduce the phenomena of deformation of the packers under the effect of such stresses, it has been proposed to reinforce the elastomer by adding thereto a metallic reinforcement constituted for example by blades of metal which are arranged in its mass like scales. Such packers are, on the one hand, of high cost price and, on the other hand, do not completely overcome the drawbacks mentioned above.

Furthermore, it has been observed that the packers of the prior state of the art act like traps with respect to rare gases such as helium, with the result that they prove to be porous upon passage of the latter.

Finally, by reason of their outer lining of elastomer, the packers prove to be fragile and this outer lining is sometimes deteriorated during their descent into the wellbore, this further contributing to their subsequent lack of mechanical strength.

SUMMARY OF THE INVENTION

The present invention has for its object to overcome these various drawbacks by proposing a novel type of packer able, on the one hand, to withstand the hostile conditions of a wellbore as well as the considerable mechanical stresses which are exerted thereon after its anchoring. It also has for its object, by improving the quality of this anchoring particularly significantly, to simplify the boring technique, in particular by avoiding being obliged to make reductions of wellbore diameter.

The present invention thus has for its object a device for obturating a wellbore, of the so-called packer type, comprising a central tubular element covered by a deformable peripheral sleeve, inside which is injected a fluid under pressure so as to deform said sleeve and apply it on the walls of the wellbore, characterized in that the deformable sleeve is constituted by a metal.

This metal may preferably be constituted by an alloy based on cupronickel.

In one embodiment of the invention, the inner wall of the sleeve forms at least one annular chamber which extends over at least a part of the surface of the sleeve and which is in communication, by an orifice, with the interior of the packer, this chamber being filled, before injection of the fluid under pressure, with a material non-miscible in the wellbore fluid. This material will advantageously be constituted by a hardened cement which, Linder the effect of the pressure due to the injection of the cement in the packer will crack, thus creating porosities forming as many passages which will allow the fluid injected under pressure to be admitted into the annular chambers and thus exert on the walls of the metallic sleeves considerable efforts of pressure distributed over the whole surface of the sleeve and which will ensure deformation of the walls thereof.

This chamber may advantageously be constituted by a bore made in the metallic sleeve which will be inwardly limited by the outer wall of a tube fitted in the sleeve.

The device according to the invention for obturating a wellbore, or packer, is particularly advantageous with respect to the devices of the prior art, insofar as, particularly when the fluid under pressure injected into the packer is constituted by cement, the latter may form one piece with the different elements of the packer and in particular with the deformable sleeve, this improving the resistance of the latter to the different stresses exerted thereon and in particular the weight of the upstreamn tubing.

BRIEF DESCRIPTION OF THE DRAWINGS

A form of embodiment of the present invention will be described hereinafter by way of non-limiting examples, with reference to the accompanying drawings, in which.

DESCRIPTION OF THE PREFERRED EMBODIMENTS

Figure 1:
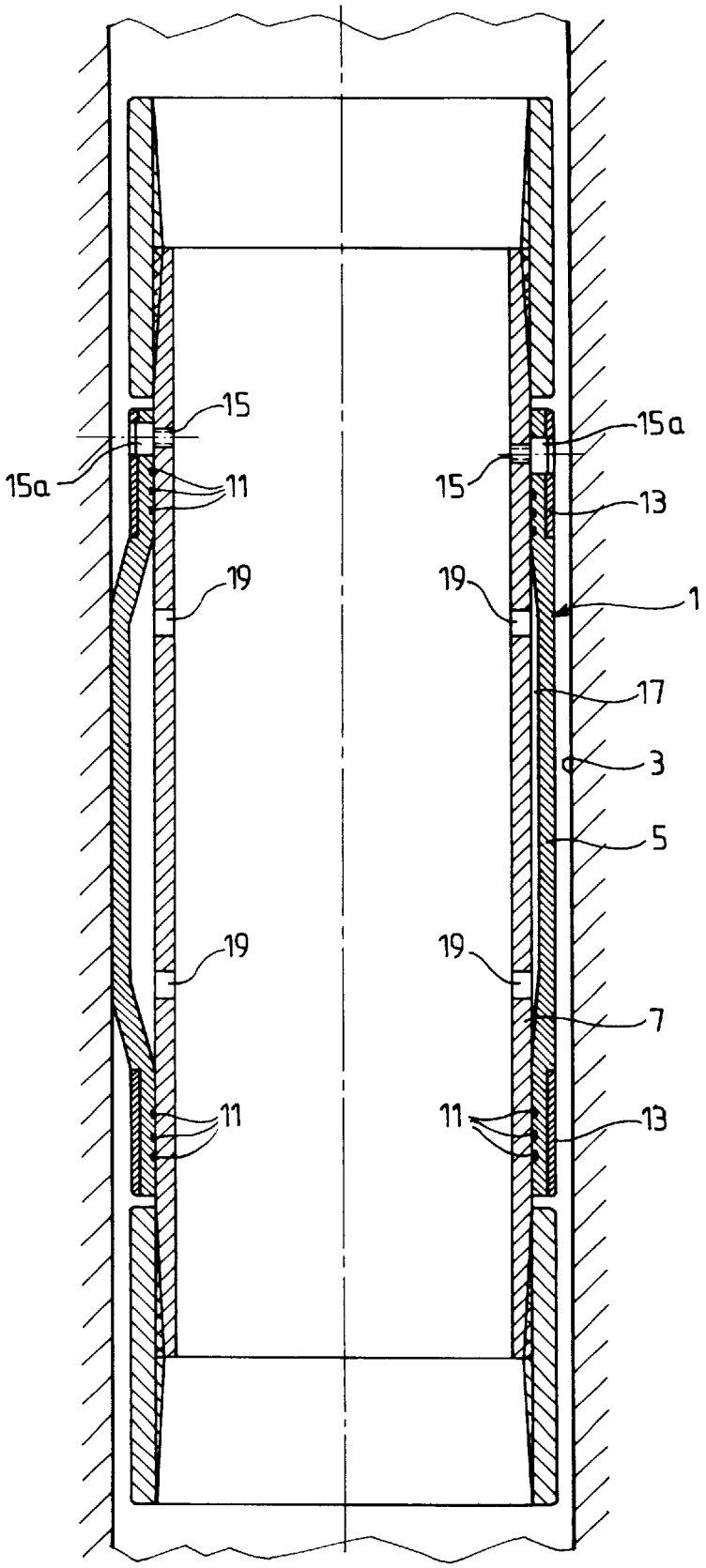
FIG. 1 is a schematic view in longitudinal section of a packer according to the invention arranged in a wellbore.

FIG. 1 shows a metallic packer 1 according to the invention which is arranged in a wellbore 3. This packer 1 is essentially composed of an outer cylindrical sleeve 5 and of a metallic tubular element 7 fitted thereinside. The right- and left-hand sides of this Figure respectively represent the packer before and after inflation of its sleeve.

The sleeve 5 is constituted by a metal presenting good characteristics of resistance to corrosion which is easy to machine, and which can undergo considerable deformations without noteworthy loss of its mechanical characteristics.

The different tests which have been made established that alloys of copper and of nickel, particularly those comprising respective iron and manganese contents of the order of 1.5% and 0.8%, were particularly advantageous. An alloy of composition CuNi10FeMn1 will thus be retained in particular, i.e. an alloy whose composition is:

| | |
|---|---|
| Copper | 87.7% |
| Nickel | 10% |
| Iron | 1.5% |
| Manganese | 0.8% |

Other types of alloys may, of course, be used, and particularly alloys of mild stainless steel, alloys based on copper and aluminium, will be retained in particular.

The inner surface of the ends of the sleeve 5 has three circular grooves hollowed out therein, which receive O-rings 11 ensuring a seal between this sleeve and the tubular element 7. The outer ends of the sleeve 5 each have a circular bore hollowed out therein, inside which is force-fitted a steel ring 13, forming hoop, intended to prevent any deformation of the end parts of the sleeve 5. The connection of the ring 13 and of the sleeve 5 with the tubular element 7 is ensured via an immobilization of these elements in translation, which is obtained by means of a screw 15 screwed in the tubular element 7 and of which the head 15*a* is positioned in appropriate recesses provided in the ring 13 and in the sleeve The central inner face of the sleeve 5 included between the hoops 13 has a recess hollowed out therein, reducing, in this central part, the thickness of the sleeve 5 and which forms with the outer face of the tubular element 7 an annular chamber 17. This chamber 17 communicates with the interior of the tubular element 7 via openings 19.

Figure 2:
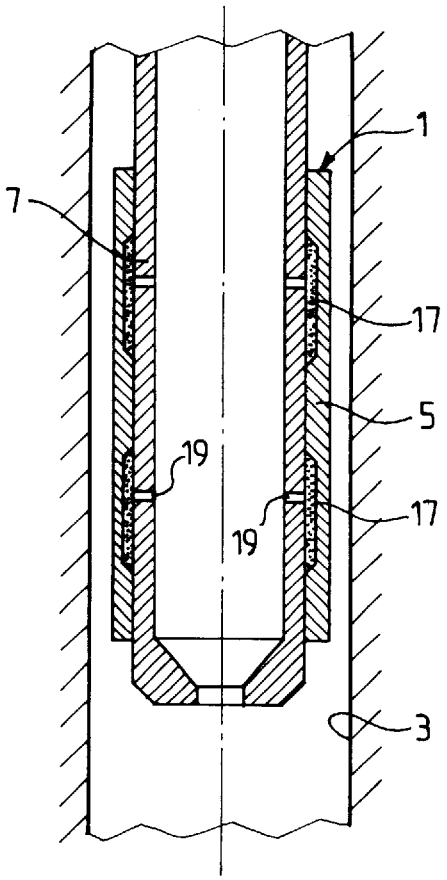
FIGS. 2 and 3 are schematic views of two steps of employing a packer according to the invention.
Figure 3:
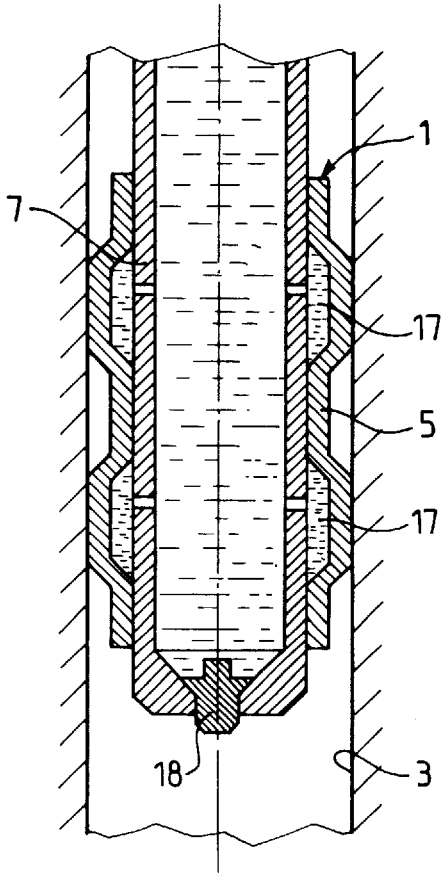

As schematically shown in FIGS. 2 and 3, the interior of the chamber 17 is filled with a hardened cement which is intended to avoid the liquid existing in the wellbore filling the latter.

After having positioned the packer 1 according to the invention in the wellbore 3 at the level where it is desired to anchor it and having obturated the front part of the packer by means of an obturator 18, a product, such as in particular a cement, is injected under high pressure, in known manner, inside the tubular element 7. Under these conditions, the cement injected under pressure inside the tubular element 7 penetrates under high pressure, in the orifices 19, breaks the hardened cement contained in the chamber 17 and, on doing so, creates therein interstices which allow it to penetrate in the chamber 17 over the whole periphery thereof, this having the effect of promoting the application of the pressure communicated by the injected cement to the total surface of the deformable part of the sleeve 5. Consequently, the latter begins to be deformed, which then promotes penetration of the cement under pressure in the chamber 17 and has the effect of strongly applying the outer face of the sleeve 5 against the inner wall of the well 3. Once the cement is hardened, anchoring of the packer is ensured.

The creation of the chamber 17 which extends over virtually the whole of the inner surface of the sleeve 5 makes it possible to apply the force of pressure coming from the injection cement on the whole of this wall, which has the effect of promoting deformation thereof According to the invention, the filling of the chamber 17 by a hardened cement prevents the liquid which circulates in the well, or wellbore fluid, from coming inside this chamber before the injection of the cement under pressure, which would have the effect of provoking a dilution thereof after the injection, with for consequences a reduction in the qualities of mechanical strength of the cement injected into this chamber 17.

The chamber 17 may, of course, be filled with other products, in particular products capable of breaking under the effect of the force of injection of the cement, so as thus to create multiple passages allowing the injected cement to penetrate in the chamber 17 in order to provoke deformation of the part of the sleeve 5 and inflation thereof. In particular, gypsum may thus be used, or, for example, an epoxy resin. Micro-balls of glass capable of breaking under the effect of the force of injection of the cement might also be employed.

The invention is particularly interesting in that it ensures that the injected cement catches on the outer metallic sleeve 5, which catching could not be envisaged when the outer sleeves were made of an elastomer. In this way, if, between the steps represented in FIGS. 2 and 3, i.e. before obturation of the tubular element 7 by the obturator 18, cement is injected on the wall 3 of the wellbore, this cement, after inflation of the sleeve 5, will form one piece therewith and with the walls of the well 3, which, of course, will considerably improve anchoring of the packer 1 and will render the latter virtually unremovable.

The present embodiment is particularly interesting in that it makes it possible, contrary to the packers made of elastomer of the prior state of the art, to create on the outer surface of the deformable sleeve roughness constituting veritable spikes, further improving the anchoring of the packer on the inner wall of the well.

Figure 4:
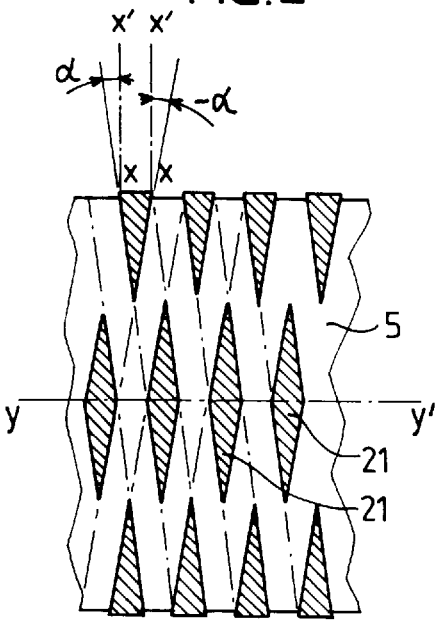
FIG. 4 is a partial outside view showing a form of embodiment of a metallic packer according to the invention.

As shown in FIG. 4, the outer surface of the metallic sleeve 5 thus comprises circular grooves (represented in broken lines in the Figure) inclined with respect to the transverse axis xx' thereof and which are alternate in direction with respect to that axis, so as successively to make angles $\alpha$ and $-\alpha$, with the effect of forming spikes 21 of which the shape seen in plan view substantially constitutes rhombi. Spikes might, of course, be made in any other shape.

The present invention also makes it possible to combine good qualities of anchoring and good qualities of seal.

Figure 5:
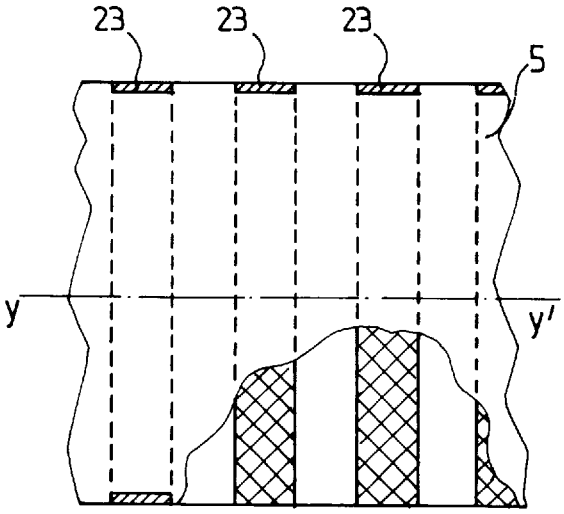
FIG. 5 is a partial view in longitudinal section showing a form of embodiment of a metallic packer according to the invention.

Thus, in a variant embodiment of the invention shown in FIG. 5, when, for technical reasons, it is desired to privilege the seal existing between the packer and the inner surface of the well in which it is arranged, grooves hollowed out on the outer surface of the sleeve 5 (in particular circular grooves) are filled with an elastomer product 23, an elastic epoxy resin, etc . . . which gives the sleeve 5 good qualities of seal while conserving therefor good qualities of anchoring thanks to its rigid roughness forming spikes existing between these grooves.

Of course, the metallic packers according to the invention may be produced with different diameters and different lengths, as a function of the wellbore and of the specific applications which they must satisfy.

What is claimed is:

1. A packer for obturating a wellbore, comprising a central tubular element (7) covered by a deformable peripheral sleeve (5), inside which sleeve is injected a fluid under pressure so as to deform said sleeve (5) and to expand the sleeve to contact walls of the wellbore (3), characterized in that the deformable sleeve (5) is constituted by a metal and an inner wall of the sleeve (5) forms at least one annular chamber (17) extending over at least a part of the surface of the sleeve (5) and in communication, by an orifice (19), with the interior of the packer, the chamber (17) being filled, before injection of the fluid under pressure, with a material non-miscible in the wellbore fluid.

2. Device according to claim 1, characterized in that the chamber (17) is constituted by a bore made in the deformable sleeve (5), which is inwardly limited by the outer wall of a tube (7) fitted in the sleeve (5).

3. Device according to claim 1, characterized in that the material is constituted by hardened cement.

4. Device according to claim 1, characterized in that the metal is a cupronickel alloy.

5. Device according to claim 4, characterized in that the alloy contains a quantity of nickel close to 10%.

6. Device according to claim 4, characterized in that the alloy is an alloy of type CuNi10FeMn1.

7. Device according to claim 1, characterized in that the outer surface of the sleeve comprises roughness for catching.

8. Device according to claim 7, characterized in that hollows between the roughness are filled, at least partly, with an elastomer.

9. A packer for obturating a wellbore by sealing contact with a wellbore wall, comprising:

a deformable outer metallic cylindrical sleeve (5);

a metallic tubular element (7) fitted inside the sleeve and having an upper end opening and a lower end opening;

O-rings (11) inserted in circular grooves hollowed out on an inner surface of end portions of the sleeve, the O-rings sealing the sleeve against the tubular element and forming upper and lower O-ring sets;

metallic rings (13) fitted in circular bores hollowed out on an exterior surface of end portions of the sleeve and forming upper and lower rings;

a screw (15) locking together upper end portions of the tubular element and the sleeve;

an annular chamber (17) formed between an exterior surface of the tubular element and the interior surface of the sleeve, the annular chamber being intermediate the upper and lower O-ring sets; and openings (19) within the tubular element providing communication paths between the annular chamber and an interior of the tubular element, the openings providing a path for injection of a material into the annular chamber and to outwardly deform the sleeve causing the deformed sleeve to expand into sealing contact with the borehole wall.

10. The packer of claim 9, wherein the screw penetrates the upper ring.

11. The packer of claim 9, further comprising an obturator (18) sealing the lower end opening of the tubular element.

12. The packer of claim 9, comprising plural of the annual chamber.

13. The packer of claim 9, wherein the exterior of the sleeve further comprises a roughness for catching.

14. The packer of claim 13, wherein the roughness constitutes veritable spikes.

15. The packer of claim 9, wherein the exterior of the sleeve further comprises circular intersecting grooves inclined with respect to a transverse axis of the sleeve.

16. The packer of claim 15, wherein the intersecting grooves form spikes having a rhombi shape.

17. The packer of claim 9, wherein the exterior of the sleeve further comprises exterior circular grooves filled with an elastomer product.

18. The packer of claim 17, further comprising spikes located between the exterior circular grooves.

19. A packer for obturating a wellbore by sealing contact with a wellbore wall, comprising:

a deformable outer metallic cylindrical sleeve (5) having a non-uniform thickness along a vertical length, sections of the sleeve having a reduced thickness defining deformable expansion sections expandable under pressure into contact with the borehole wall, the sleeve having an upper end and a lower end;

a metallic tubular element (7) fitted inside the sleeve and having an upper end and a lower end sealed against the upper end and the lower end respectively of the sleeve;

an annular chamber (17) formed between an exterior surface of the tubular element and the interior surface of the sleeve, the annular chamber being intermediate the upper and lower ends of the sleeve; and openings (19) within the tubular element providing communication paths between the annular chamber and an interior of the tubular element, the openings providing a path for injection of a material into the annular chamber to pressurize the annular chamber to outwardly deform the deformable expansion sections of the sleeve causing the deformed expansion sections to expand into sealing contact with the borehole wall.

20. The packer of claim 19, wherein the exterior of the sleeve further comprises a roughness for catching.

* * * * *